US011713633B2

(12) United States Patent
Smith et al.

(10) Patent No.: US 11,713,633 B2
(45) Date of Patent: Aug. 1, 2023

(54) DRY PRODUCT ADDITIVE UNIT

(71) Applicant: STEWART & STEVENSON LLC, Houston, TX (US)

(72) Inventors: Jeff Smith, Pinehurst, TX (US); Brian Sharp, Houston, TX (US); Mark Payne, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 0 days.

(21) Appl. No.: 17/387,289

(22) Filed: Jul. 28, 2021

(65) Prior Publication Data

US 2023/0031169 A1 Feb. 2, 2023

(51) Int. Cl.

| | |
|---|---|
| ***E21B 21/08*** | (2006.01) |
| ***E21B 43/26*** | (2006.01) |
| ***E21B 21/06*** | (2006.01) |
| ***E21B 21/01*** | (2006.01) |

(52) U.S. Cl.

CPC ..... *E21B 21/062* (2013.01); *E21B 21/01* (2013.01); *E21B 21/08* (2013.01)

(58) Field of Classification Search

CPC ..... E21B 21/08; E21B 43/26; E21B 43/2607

See application file for complete search history.

(56) References Cited

U.S. PATENT DOCUMENTS

| | | | | |
|---|---|---|---|---|
| 5,190,374 | A * | 3/1993 | Harms | B01F 25/721 366/175.2 |
| 5,544,951 | A * | 8/1996 | Alack | B28C 9/04 366/163.2 |
| 6,190,461 | B1 * | 2/2001 | Alack | B01F 35/82 366/132 |
| 7,740,399 | B2 * | 6/2010 | Simmons | B01F 35/8821 366/153.1 |
| 11,060,365 | B2 * | 7/2021 | Kapila | B01F 25/31243 |
| 2010/0243252 | A1 * | 9/2010 | Luharuka | E21B 43/267 166/75.15 |
| 2014/0110425 | A1 * | 4/2014 | Pahl | E21B 41/00 222/630 |

FOREIGN PATENT DOCUMENTS

CN 203002294 U * 6/2013

* cited by examiner

*Primary Examiner* — Matthew R Buck
(74) *Attorney, Agent, or Firm* — Ewing & Jones, PLLC

(57) ABSTRACT

A dry product additive system includes a skid, a hopper, a pickup funnel, a feeder system, a supply pump, and an eductor assembly. The feeder system may be configured to transport product from the hopper to the pickup funnel. The eductor assembly including a suction inlet, a motive inlet, and an outlet. The suction inlet may be coupled to the pickup funnel by a suction hose. The motive inlet may be coupled to the supply pump by a motive fluid hose.

19 Claims, 6 Drawing Sheets

DRY PRODUCT ADDITIVE UNIT

TECHNICAL FIELD/FIELD OF THE DISCLOSURE

The present disclosure relates generally to well service equipment and specifically to equipment used with well fluids.

BACKGROUND OF THE DISCLOSURE

During drilling, completion, and production operations, fluids are circulated through a wellbore. Various chemicals are introduced into the fluids, referred to herein as the slurry, to produce slurry having desirable characteristics. In some cases, chemicals may be provided in dry form.

SUMMARY

The present disclosure provides for a dry product additive system. The dry product additive system may include a skid. The dry product additive system may include a hopper. The dry product additive system may include a pickup funnel. The dry product additive system may include a feeder system configured to transport product from the hopper to the pickup funnel. The dry product additive system may include a supply pump. The dry product additive system may include an eductor assembly, the eductor assembly including a suction inlet, a motive inlet, and an outlet. The suction inlet may be coupled to the pickup funnel by a suction hose. The motive inlet may be coupled to the supply pump by a motive fluid hose.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
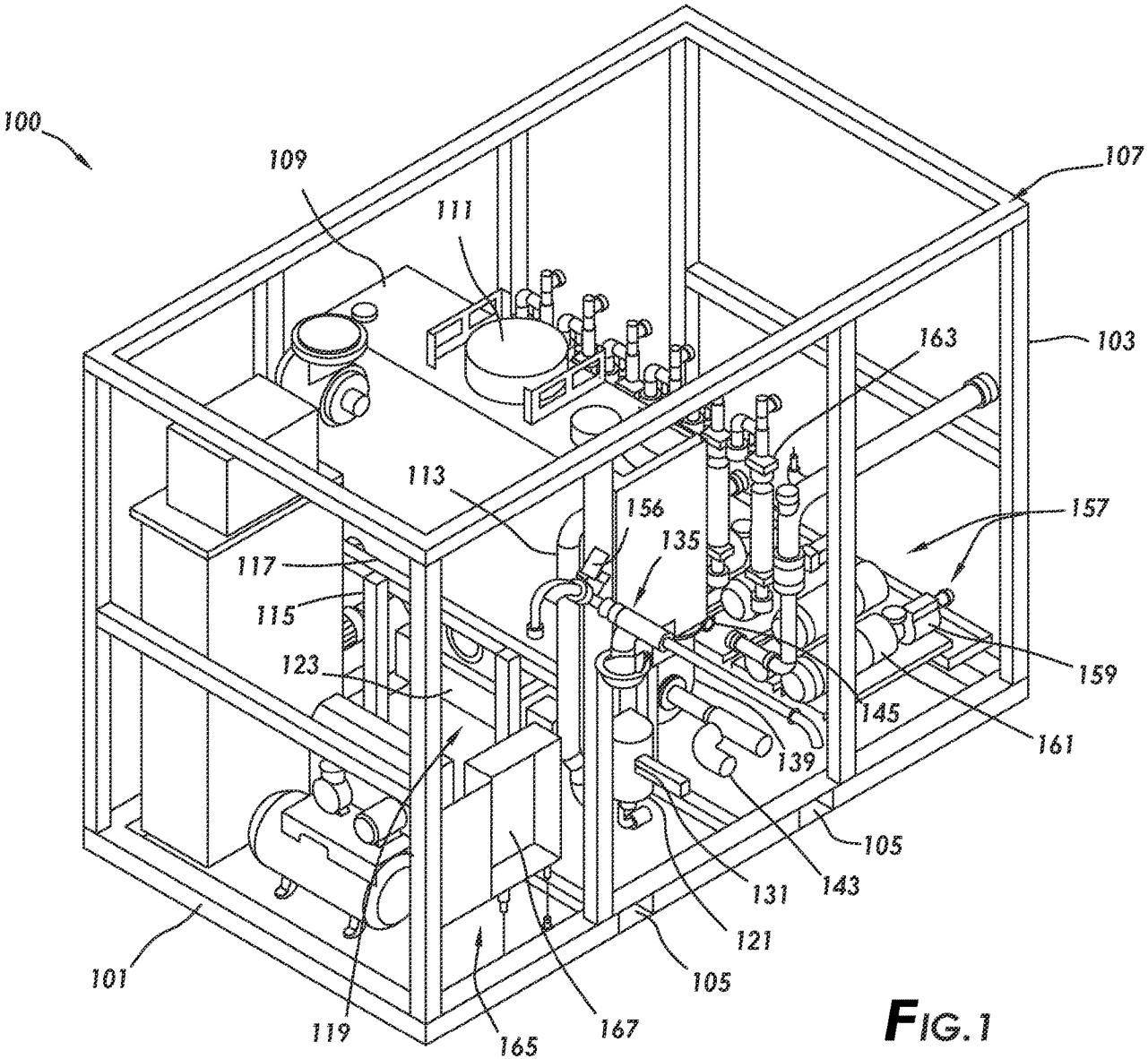
FIG. 1 depicts a perspective view of a dry product additive system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIGS. 1-4 depict views of dry product additive system 100 consistent with at least one embodiment of the present disclosure. Dry product additive system 100 may include skid 101. Skid 101 may be positioned to support and facilitate transportation of dry product additive system 100. In some embodiments, dry product additive system 100 may include frame 103. Frame 103 may be mechanically coupled to skid 101 and may be used to house, support, and protect components of dry product additive system 100 such as during transportation. In some embodiments, skid 101 or frame 103 may include features to assist with transportation of dry product additive system 100 including, for example and without limitation, fork holes 105 for use with a forklift and upper lifting points 107.

In some embodiments, dry product additive system 100 may include hopper 109. Hopper 109 may be used to store dry chemicals, referred to herein as product, for use in a well operation. For example, in some embodiments, hopper 109 may be used to store guar gel, friction reducer, or high-viscosity friction reducer. In some embodiments, hopper 109 may be fillable during operation of dry product additive system 100. In such embodiments, hopper 109 may remain at atmospheric pressure during operation of dry product additive system 100. In some embodiments, hopper 109 may include upper hatch 111 positioned at an upper surface of hopper 109 to allow product to be added to hopper 109. In some embodiments, dry product additive system 100 may include hopper fill tube 113 (shown in FIGS. 1, 2, and 4). Hopper fill tube 113 may be coupled to hopper 109 and may allow for product to be added to hopper 109 without opening upper hatch 111.

In some embodiments, hopper 109 may be supported by hopper support struts 115 coupled to skid 101. In some embodiments, one or more load cells 117 may be positioned between hopper 109 and hopper support struts 115 to, for example and without limitation, measure the weight of hopper 109 and thereby monitor the amount of product within hopper 109 during use.

Figure 5:
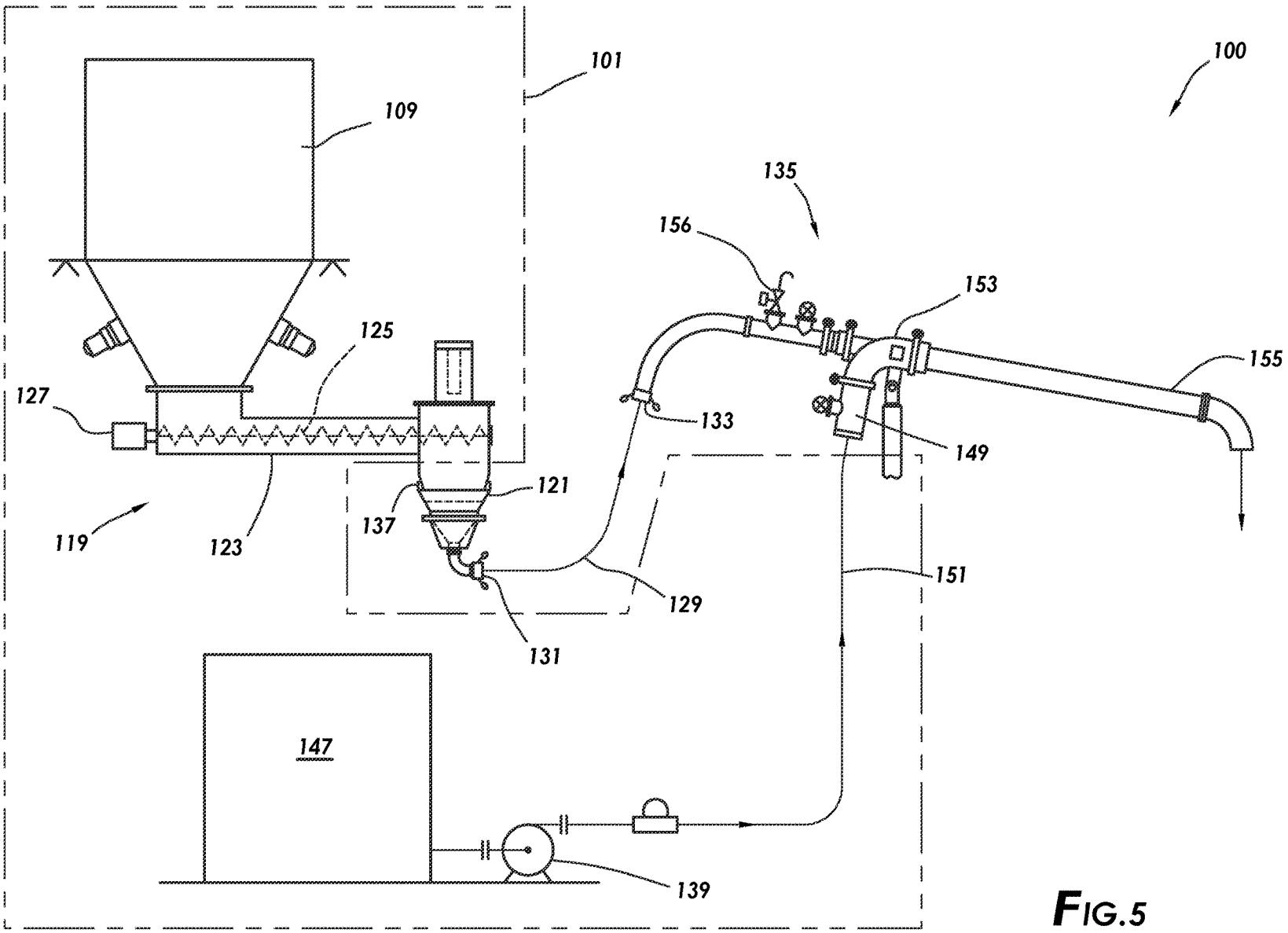
FIG. 5 depicts a schematic of a dry product additive system consistent with at least one embodiment of the present disclosure.

In some embodiments, dry product additive system 100 may include feeder system 119. Feeder system 119 may be positioned beneath hopper 109 and may be used to deliver product from within hopper 109 to pickup funnel 121. As shown in FIG. 5, feeder system 119 may include trough 123 positioned beneath hopper 109 and positioned to receive product from hopper 109 by gravity feed. In some embodiments, feeder system 119 may include feed auger 125 positioned within trough 123 such that rotation of feed auger 125 moves product through trough 123 and into pickup funnel 121. In some embodiments, feed auger 125 may be driven by feeder motor 127, which may be an electric motor.

In some embodiments, pickup funnel 121 may be coupled to suction hose 129, which may couple between output flange 131 of pickup funnel 121 and suction inlet 133 of eductor assembly 135. As discussed below, eductor assembly 135 may provide suction force to move the product within pickup funnel 121 through suction hose 129 and into eductor assembly 135. In some such embodiments, pickup funnel 121 may include vents 137 positioned to allow air to enter pickup funnel 121 as product is removed from pickup funnel 121.

Figure 2:
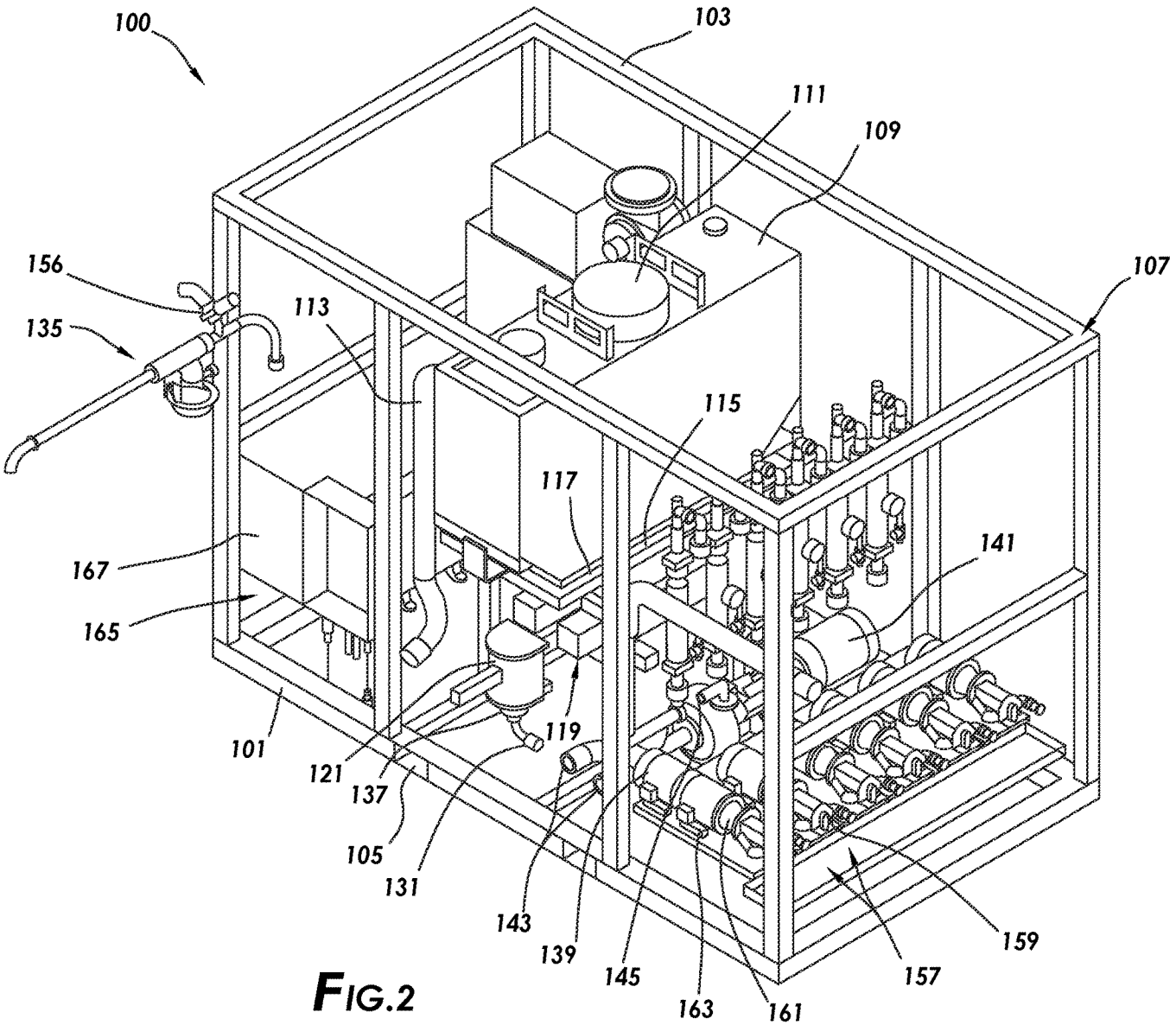
FIG. 2 depicts an alternate perspective view of the dry product additive system of FIG. 1.
Figure 3:
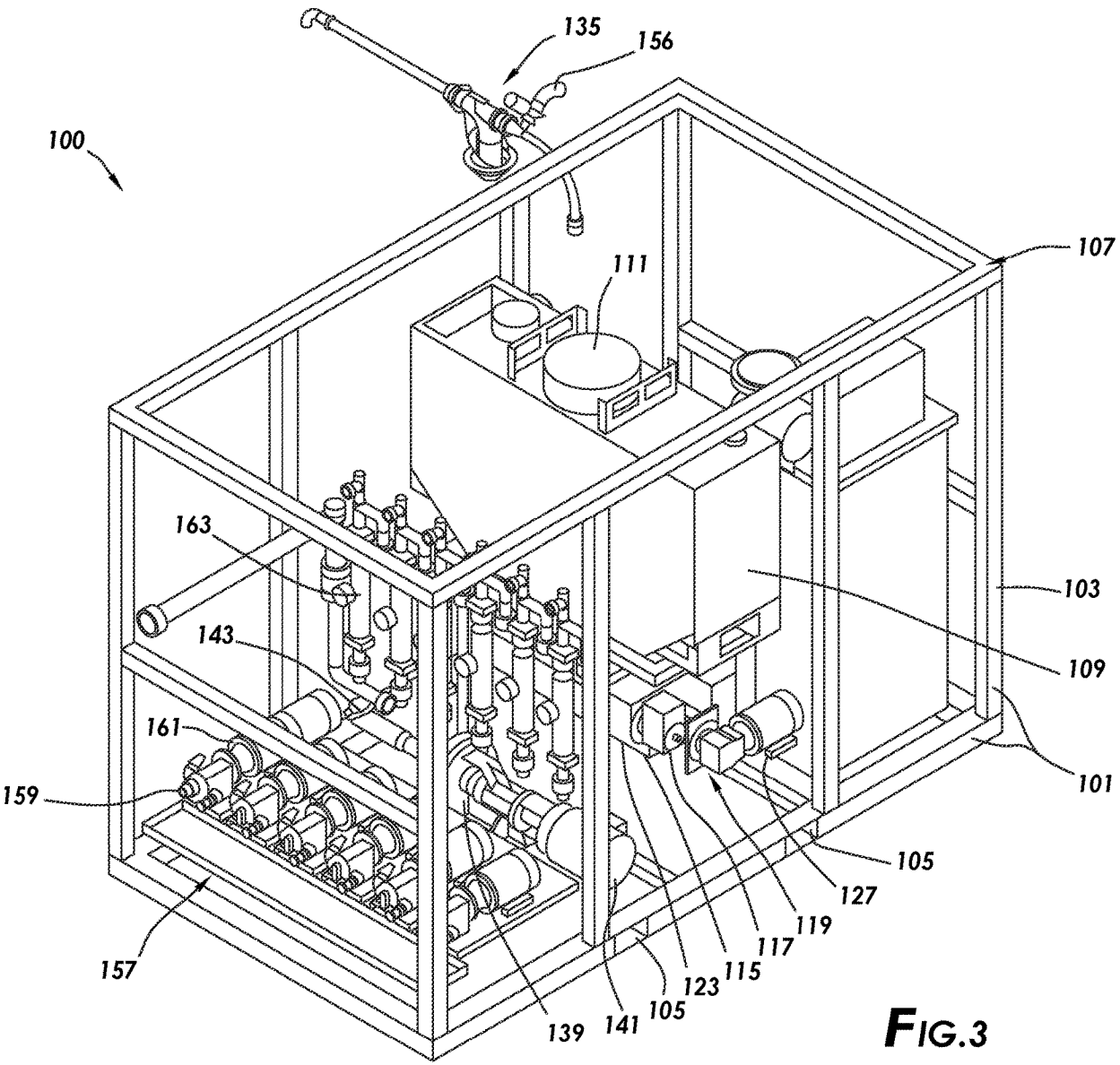
FIG. 3 depicts an alternate perspective view of the dry product additive system of FIG. 1.
Figure 4:
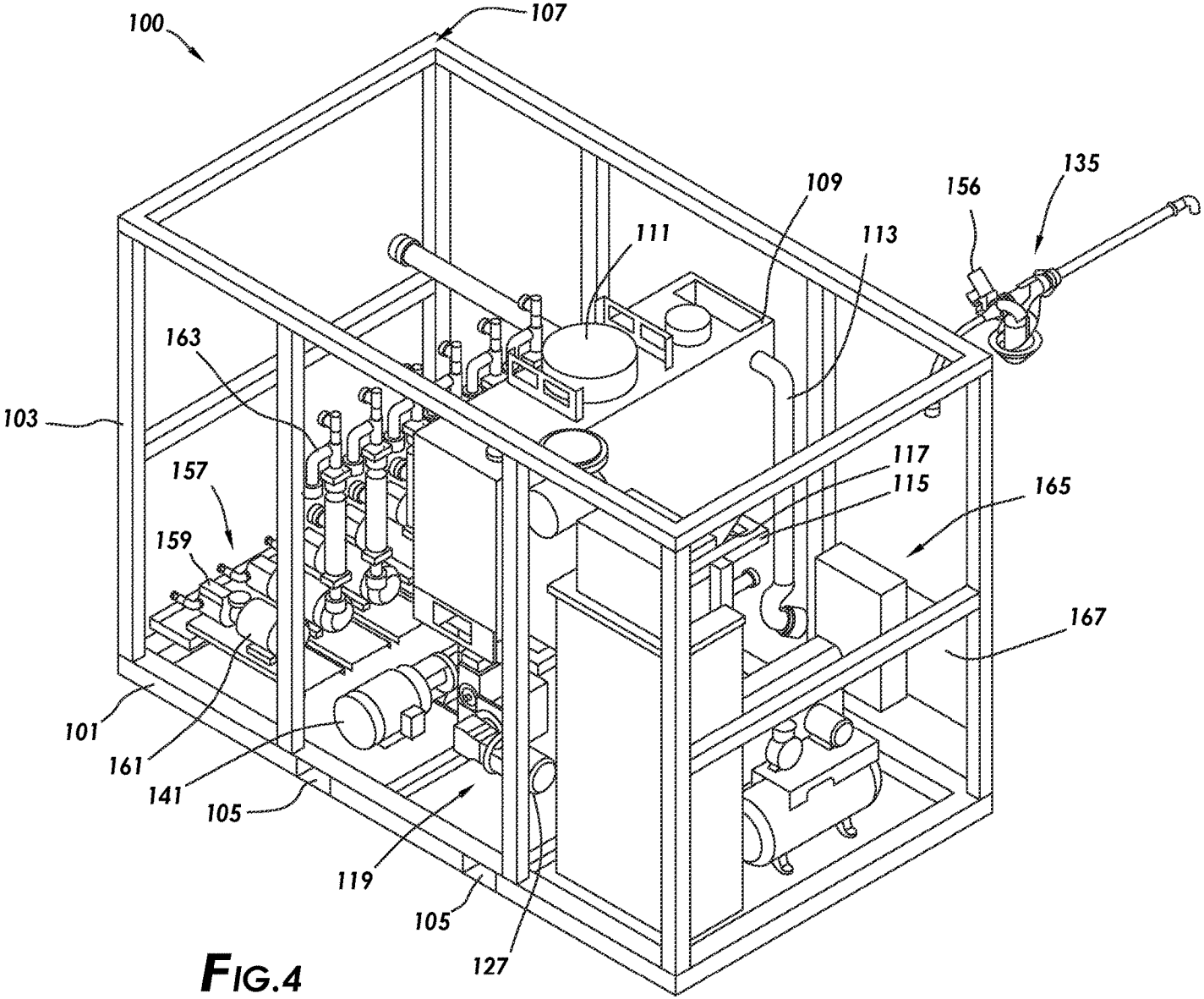
FIG. 4 depicts an alternate perspective view of the dry product additive system of FIG. 1.

In some embodiments, dry product additive system 100 may include supply pump 139. Supply pump 139 may, in some embodiments, be a centrifugal pump driven by pump motor 141 (as shown in FIG. 4), which may be an electric motor. In other embodiments, supply pump 139 may be, for example and without limitation, a gear pump, rotary vane pump, lobe pump, piston pump, diaphragm pump, screw pump, peristaltic pump, or axial flow pump. Supply pump 139 may receive a fluid through pump inlet 143 and output the fluid through pump outlet 145 (as shown in FIGS. 1 and 2). In some embodiments, the fluid, referred to herein as the motive fluid, may be water as supplied by water supply 147 as shown in FIG. 5. Water supply 147 may be positioned on skid 101 or may be positioned apart from skid 101. Water supply 147 may be a tank or other reservoir. Although described as a water supply, any liquid may be used as described herein. In some embodiments, pump outlet 145 may be coupled to motive inlet 149 of eductor assembly 135 by motive fluid hose 151.

When supply pump 139 is engaged, motive fluid is pumped through motive fluid hose 151 into motive inlet 149 of eductor assembly 135. Eductor assembly 135 may include eductor 153. Eductor 153 may be a venturi that, without being bound to theory, produces suction or sub-ambient pressure at suction inlet 133 due to the high-speed motion of the motive fluid when the motive fluid is pumped into eductor 153. The suction at suction inlet 133 may draw product into eductor 153 through suction hose 129 from pickup funnel 121.

In some embodiments, dry product additive system 100 may include vacuum breaker valve 156. Vacuum breaker valve 156 may be positioned on eductor assembly 135 such that vacuum breaker valve 156 is fluidly coupled to suction inlet 133 before eductor 153. Vacuum breaker valve 156 may be used to allow sufficient pressure in motive fluid hose 151 and eductor assembly 135 to be built up during startup of supply pump 139. If such pressure is not adequately built up, fluid from motive fluid hose 151 may backfeed through eductor assembly 135 and into other components of dry product additive system such as hopper 109 via suction hose 129. During startup of supply pump 139, vacuum breaker valve 156 may be opened, allowing air to enter eductor assembly 135 and reducing or preventing suction forces to act on suction hose 129. Once sufficient pressure is reached in motive fluid hose 151, vacuum breaker valve 156 may be closed, allowing the suction force generated by eductor assembly 135 to act on suction hose 129 and draw the product within pickup funnel 121 into eductor assembly 135. Similarly, during shutdown of dry product additive system 100, vacuum breaker valve 156 may be opened to reduce or remove suction force on suction hose 129, thereby reducing or stopping the flow of product into eductor assembly 135 and also preventing or reducing the incidence of backflow of motive fluid through suction hose 129.

In some embodiments, eductor 153 may introduce product into the stream of motive fluid as both the product and motive fluid pass through eductor 153 or other components of eductor assembly 135 such as outlet nozzle 155. Outlet nozzle 155 may be positioned to eject the combination of motive fluid and product into other locations such as other equipment. For example and without limitation, in some embodiments, the stream of motive fluid and product may be introduced into a well servicing blender or other piece of equipment to introduce the stream into the wellbore. In some embodiments, where the other piece of equipment or manifold is pressurized, outlet nozzle 155 may be directly coupled to the piece of equipment or manifold such that the stream may be introduced thereinto.

In some embodiments, dry product additive system 100 may include additional equipment for use in a well servicing operation. For example, in some embodiments, with reference to FIGS. 2 and 3, dry product additive system 100 may include liquid add pump assemblies 157 positioned on skid 101. Liquid add pump assemblies 157 may each be operable to supply a liquid for use in a well servicing operation. In some embodiments, each liquid add pump assembly 157 may include liquid add pump 159, liquid add pump motor 161, and flow meter 163.

In some embodiments, components of dry product additive system 100 may be operated using control system 165. Control system 165 may be operatively connected to and used to control one or more of feeder motor 127, pump motor 141, and liquid add pump motors 161. In some embodiments, control system 165 may be operatively connected to and receive measurements from load cells 117 and flow meters 163. In some embodiments, control system 165 may automatically operate feeder motor 127 based on the operation of dry product additive system 100 such that a sufficient amount of product is provided to pickup funnel 121.

In some embodiments, with reference to FIGS. 1 and 2, dry product additive system 100 may include human machine interface (HMI) 167. HMI 167 may be mounted on skid 101 or frame 103 and may include one or more controls to allow a user to interact with and control components of dry product additive system 100 via control system 165 locally. In some embodiments, HMI 167 may include a display, which, for example and without limitation, may display information such as operational status of feeder system 119, supply pump 139, and liquid add pump assemblies 157. In some embodiments, HMI 167 may display information such as the weight of hopper 109 as measured by load cells 117 or the readings from flow meters 163. In some embodiments, HMI 167 may allow a user to control the operation of feeder motor 127, pump motor 141, and liquid add pump motors 161.

In some embodiments, control system 165 may include one or more telemetry systems including, for example and without limitation, one or more transceivers used to allow a wired or wireless data connection with a remote terminal. For example, in some such embodiments, dry product additive system 100 may be controlled remotely such as from a data van on site or from a remote location. In some embodiments, control system 165 may include a wireless transceiver capable of communicating with a remote location via, for example and without limitation, one or more of a Wi-Fi, cellular, GSM, LTE, CDMA, or satellite interlink. In some embodiments, control system 165 may allow for control of dry product additive system 100 via an internet connection.

Figure 6:
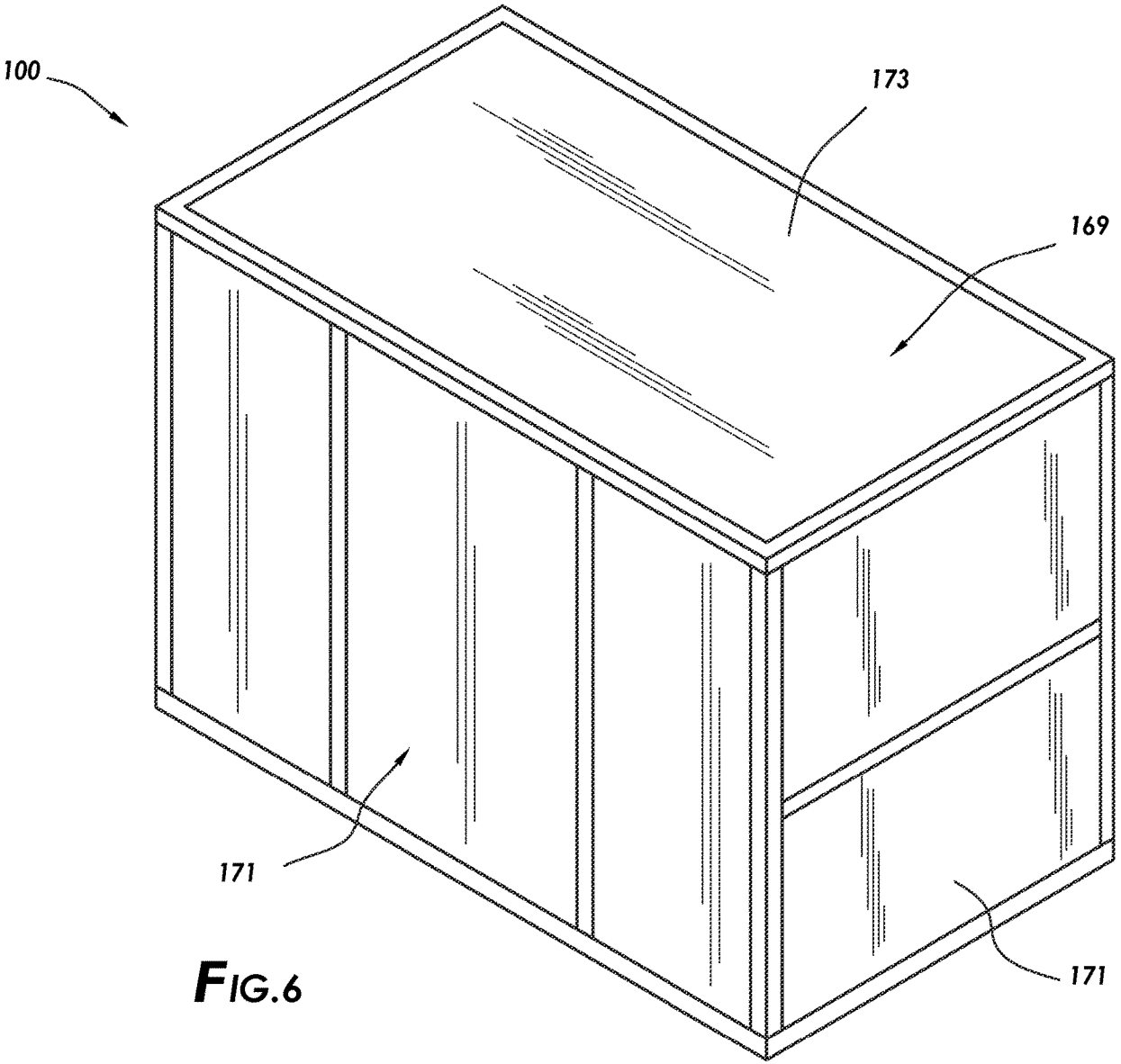
FIG. 6 depicts a perspective view of a dry product additive system consistent with at least one embodiment of the present disclosure.

In some embodiments, as shown in FIG. 6, dry product additive system 100 may include enclosure 169. Enclosure 169 may include one or more side panels 171 and top panel 173 positioned about frame 103 to at least partially enclose the components of dry product additive system 100.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A dry product additive system comprising:

a skid;

a hopper, the hopper adapted to hold product;

a pickup funnel, the pickup funnel including a vent, the vent positioned to allow air to enter the pickup funnel as product is removed from pickup funnel;

a feeder system, the feeder system configured to transport product from the hopper to the pickup funnel;

a supply pump; and an eductor assembly, the eductor assembly including a suction inlet, a motive inlet, and an outlet, the suction inlet coupled to the pickup funnel by a suction hose, the motive inlet coupled to the supply pump by a motive fluid hose.

2. The dry product additive system of claim 1, further comprising a frame mechanically coupled to the skid.

3. The dry product additive system of claim 1, wherein the hopper further comprises an upper hatch.

4. The dry product additive system of claim 1, further comprising a hopper fill tube, the hopper fill tube coupled to the hopper.

5. The dry product additive system of claim 1, wherein the feeder system comprises a trough, the trough positioned below the hopper such that product positioned within the hopper is gravity fed into the trough, the trough coupled to the pickup funnel.

6. The dry product additive system of claim 5, wherein the feeder system comprises a feed auger, the feed auger positioned within the trough.

7. The dry product additive system of claim 6, wherein the feed auger is driven by a feeder motor.

8. The dry product additive system of claim 1, further comprising a load cell positioned between the hopper and the skid.

9. The dry product additive system of claim 1, wherein the supply pump is a centrifugal pump.

10. The dry product additive system of claim 1, wherein the supply pump is driven by a pump motor.

11. The dry product additive system of claim 1, further comprising a water supply, the water supply coupled to a pump inlet of the supply pump.

12. The dry product additive system of claim 11, wherein the water supply is a tank.

13. The dry product additive system of claim 1, further comprising a liquid add pump assembly, the liquid add pump assembly including a liquid add pump and a liquid add pump motor.

14. The dry product additive system of claim 13, wherein the liquid add pump assembly further comprises a flow meter.

15. The dry product additive system of claim 1, further comprising a control system, the control system configured to control the feeder system and the supply pump.

16. The dry product additive system of claim 15, further comprising a human machine interface (HMI) configured to allow a user to control the dry product additive system locally.

17. The dry product additive system of claim 15, wherein the control system further comprises a transceiver to allow wireless or wired remote control of the dry product additive system.

18. The dry product additive system of claim 17, wherein the transceiver is a Wi-Fi, cellular, GSM, LTE, CDMA, or satellite interlink.

19. The dry product additive system of claim 1, further comprising a vacuum breaker valve positioned on the eductor assembly fluidly coupled to the suction inlet.

* * * * *